US006767015B1

(12) United States Patent
Parsley

(10) Patent No.: US 6,767,015 B1
(45) Date of Patent: Jul. 27, 2004

(54) THERMAL TARGET

(75) Inventor: Adam Parsley, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/456,243

(22) Filed: Jun. 5, 2003

(51) Int. Cl.[7] ..... F41J 2/02
(52) U.S. Cl. ..... 273/348.1
(58) Field of Search ..... 273/348.1, 406, 273/407; 250/495.1; 126/204; 264/53; 607/108, 109

(56) References Cited

U.S. PATENT DOCUMENTS 3,976,049 A * 8/1976 Yamashita et al. ..... 126/263.02
4,260,160 A 4/1981 Ejnell et al.
4,546,983 A 10/1985 Rosa
4,659,089 A 4/1987 Rosa
5,065,032 A 11/1991 Prosser
5,110,137 A * 5/1992 Watkins et al. ..... 273/348.1
5,397,236 A * 3/1995 Fegg et al. ..... 434/11
5,787,505 A * 8/1998 Piwko et al. ..... 2/115
5,918,590 A * 7/1999 Burkett et al. ..... 126/263.02
5,924,694 A 7/1999 Kent
5,984,953 A * 11/1999 Sabin et al. ..... 607/114
6,020,040 A * 2/2000 Cramer et al. ..... 428/64.1
6,051,840 A 4/2000 Henderson
6,337,475 B1 1/2002 Migliorini

* cited by examiner

*Primary Examiner*—Mark S. Graham
(74) *Attorney, Agent, or Firm*—Mark O. Glut

(57) ABSTRACT

An expendable thermal target for weapon fire, which includes a cloth housing and a plurality of independently contained thermal emitting cells disposed within the cloth housing.

5 Claims, 1 Drawing Sheet

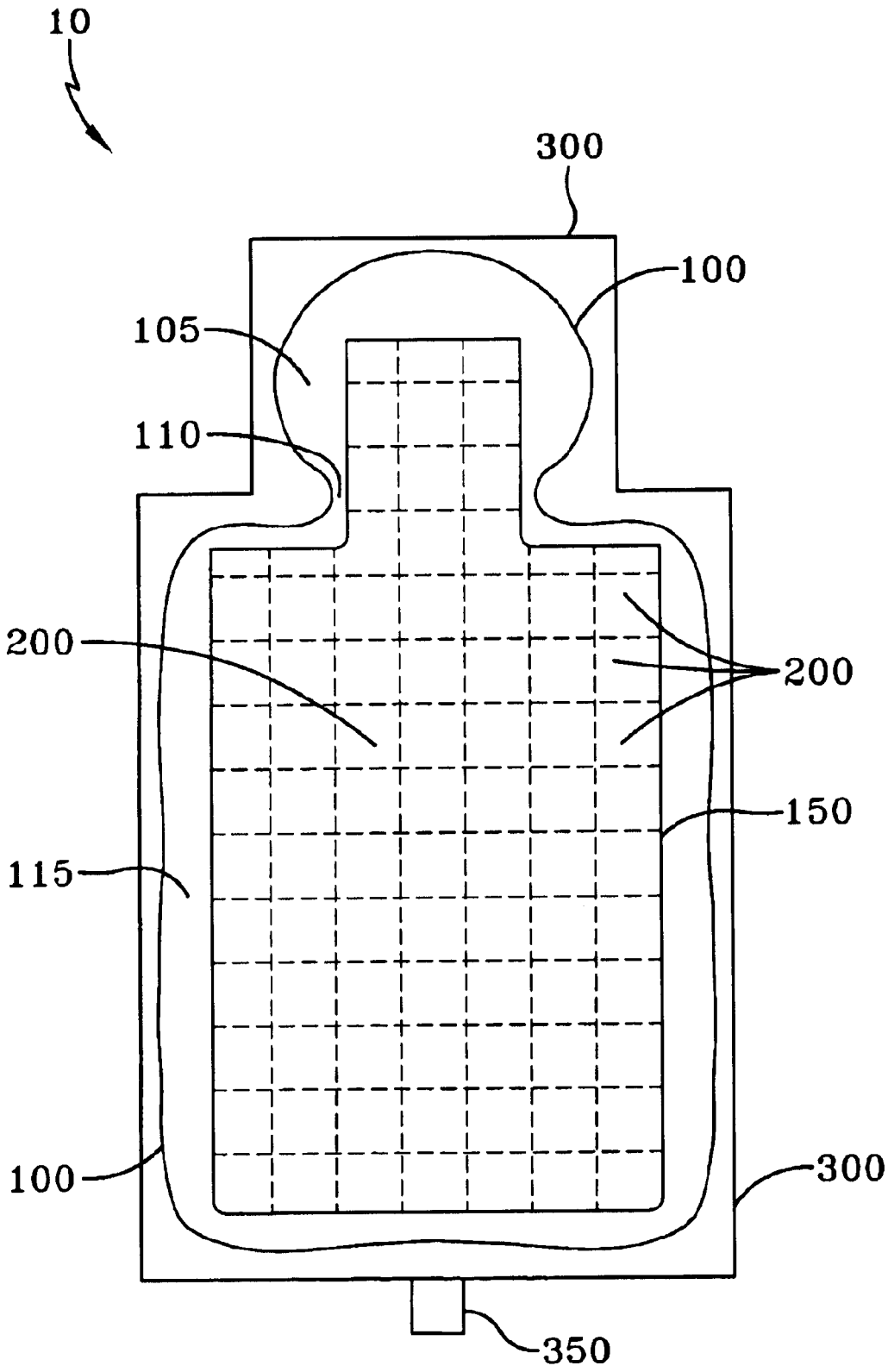
10
300
100
105
110
200
200
150
115
100
300
350

THERMAL TARGET

STATEMENT OF GOVERNMENT INTEREST

The invention described herein may be manufactured and used by or for the Government of the United States of America for governmental purposes without payment of any royalties thereon or therefor.

BACKGROUND

The present invention relates to a thermal target. More specifically, but without limitation, the present invention relates to an expendable thermal target for weapon fire, and for general observation by thermal imaging devices.

Thermal sights and heat-responsive equipment have become more and more common, especially in the defense industry. With the advent of thermal sights for hunting or for conducting military operations such as surveillance, reconnaissance, target detection and tracking, or for fire-fighting and law enforcement, there arose a need for targets suitable for conducting training in those skills.

The use of thermal sights, heat responsive sighting or tracking equipment, and search and rescue equipment requires special training, especially in military situations, because the image presented by such a device is of a different character than is perceived with visible light. Accordingly, it is necessary to afford extensive nighttime practice to personnel who are expected to use such equipment, in order to develop their ability to detect targets and recognize objects of the type at which they may have to fire in actual combat or may otherwise be required to engage with the employment of thermal imaging equipment. For such training it is necessary to have targets that emit heat radiation patterns that realistically simulate specific objects at which combat fire might be aimed (specifically a combatant), to enable realistic practice operations to be conducted at night. It is also necessary that targets that might otherwise be engaged with personnel using thermal imaging equipment, such as firefighters, offer as realistic a human signature as possible. Therefore, the targets need to emit heat in order to simulate a real-life target.

Currently operators of weapons systems with thermal sights use various methods to create a thermal target. Most current methods for generating a thermal target use some type of electrical current from an AC source or from batteries, or may even include using metal drums with fires burning in them to generate a hot target. These methods are often less desirable because of the lack of electrical wiring or AC hook-up on firing ranges, the time consuming set-up, the potential environmental hazards, or the possibility of accidentally or intentionally rupturing a battery or electrical connection in live-fire exercises. Additionally, some of these methods require the thermal target to be disposed of through special methods or channels that can be expensive and/or time consuming. Other methods use electrically resistive material and wiring that is easily damaged under weapons fire.

Thus, there is a need in the art to provide an expendable thermal target that incorporates the listed benefits without the limitations inherent in present methods. For the foregoing reasons, there is a need for an expendable thermal target for weapon fire and for general observation by thermal imaging devices.

SUMMARY

The instant invention is directed to an expendable thermal target that satisfies the needs enumerated above and below.

The present invention is directed to an expendable thermal target that includes a cloth housing and a plurality of independently contained thermal emitting cells disposed within the cloth housing.

The present invention is directed to an expendable thermal target that is inexpensive and easy to manufacture, and easy to set up in a target range or other training scenarios.

It is an object of the invention to provide an expendable thermal target that is environmentally safe.

It is an object of the invention to provide an expendable thermal target that can be disposed of in regular garbage and not required to be disposed of through special methods or channels.

It is an object of the invention to provide an expendable thermal target that has little or no potential to stop emitting a recognizable thermal signature after being hit by live ammunition.

It is an object of the invention to provide an expendable thermal target that holds up well to live weapon fire, or at a minimum continues to present a profile for weapon aiming after being hit by live weapon fire.

It is an object of the invention to provide an expendable thermal target that requires no electricity, battery or external/internal power source.

It is an object of the invention to provide an expendable thermal target that simulates the heat emitted by a combatant; thereby, creating a more realistic scenario for weapons fire exercises and training.

It is an object of the invention to provide an expendable thermal target that also provides the highest obtainable thermal contrast for easy target acquisition for weapons fire exercises and training.

It is an object of the invention to provide an expendable thermal target that produces heat by a controlled, rapid oxidation process occurring between the ingredients of iron powder, carbon, a salt, and vermiculite or other similar ingredient.

It is an object of the invention to provide an expendable thermal target that begins an oxidation process, thereby emitting heat, once the target is removed from some type of container or packaging that deprives it of exposure to atmospheric oxygen. Once removed from said package or container, the target is exposed to atmospheric oxygen and begins the oxidation process that emits heat, thereby giving the heat signature that is required for viewing by thermal imaging equipment.

DRAWING

These and other features, aspects and advantages of the present invention will become better understood with reference to the following description and appended claims, and accompanying drawing wherein;

FIG. 1 is a front cross sectional view of an embodiment of the expendable thermal target.

DESCRIPTION

The preferred embodiment of the present invention is illustrated by way of example below and in FIG. 1. As seen in FIG. 1, the expendable thermal target 10 includes a cloth housing 100 and a plurality of independently contained thermal emitting cells 200. The plurality of independently contained thermal emitting cells 200 are disposed within the cloth housing 100.

In the discussion of the present invention, the invention will be discussed in a military training environment;

however, as stated earlier, this invention can be utilized for any type of target purposes such as, but without limitations, private and public gun ranges, practice ranges, shooting tournaments, and the like. The invention can also be used to train personnel in the use of thermal imaging devices, that can be used for, but without limitation, search and rescue operations, firefighting, law enforcement, and the like. These thermal imaging devices may be, but without limitation, gun sights, equipment used for thermography, thermal imaging goggles, or the like.

A thermal emitting cell 200 may be defined, but without limitation, as a compartment or bounded area that upon activation sets forth heat or thermal energy. The thermal emitting cell 200 may be manufactured from a combination of iron powder, carbon, salt, and vermiculite or any similar oxidizing ingredients. The ingredients may be stored in a vacuum or a substantially oxygen deprived atmosphere. In the preferred embodiment, the ingredients may be stored within a vacuum container 150 that shields the ingredients from exposure to atmospheric oxygen. The thermal emitting cells 200 may be activated by exposure to air, upon opening the container 150. The thermal emitting cells 200 may be configured to release or give off thermal energy for several hours. Upon exposure to air the ingredients begin an oxidation process that emits heat or thermal energy. The ingredients of the reaction from the destroyed cells are inert and pose no threat to the environment and can be simply thrown away in the garbage after use of the expendable thermal target 10.

Each thermal emitting cell 200 is independently contained such that a single bullet penetration would not render the expendable thermal target 10 useless by scattering all the ingredients, thereby ending the reaction and usefulness of the expendable thermal target 10.

The expendable thermal target 10 may be a flat device in the approximate shape and size of a human silhouette. However, the expendable thermal target 10 may be in the shape of any other potential target such as, but without limitation, a combatant vehicle, any military standard target size, or any game animal. The silhouette shaped expendable thermal target 10 may be stabilized, attached or mounted to a harder surface 300 for support at the end of a firing range. The harder surface 300 may be, but without limitation, cardboard, plywood or any type of material that lends itself to supporting a target. The harder surface 300 may be shaped similarly to the thermal target 10. The harder surface 300 may be attached to a support device 350 to help keep the target upright. The support device 350 can be any type of device or means that can hold up, aid, or give a foundation to the thermal target 10, such as, but without limitation, a stake, a post, or a target seat.

The cloth housing 100 may have a head portion 105, a neck portion 110 and a body portion 115. The thermal emitting cells 200 located in the head portion 105 and the neck portion 110 may be configured to generate heat at approximately the normal temperature of human skin (or whatever desired temperature the user requires). The thermal emitting cells 200 located in body portion 115 of the cloth housing 100 may be configured to generate heat at approximately the normal temperature of clothed human skin. The body portion 105 and the head portion 110 of the cloth housing 100 may be configured to generate as much heat as possible to give off maximum contrast to thermal imaging equipment.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. An expendable thermal target, comprising:

(a) a cloth housing; and (b) a plurality of independently contained thermal emitting cells disposed within the cloth housing, the thermal emitting cells are manufactured from iron powder, carbon, salt, and vermiculite, the iron powder, carbon, salt, and vermiculite is packaged in substantially oxygen deprived packaging such that upon exposure to air the thermal emitting cells would give off thermal energy for several hours, the thermal target is attached to a harder surface for support at the end of a range.

2. The expendable thermal target of claim 1, wherein the cloth housing being substantially flat and the approximate shape and the approximate size of a human silhouette.

3. The expendable thermal target of claim 2, wherein the cloth housing having a head portion, a neck portion and a body portion, the thermal emitting cells located in the head portion and the neck portion configured to generate heat at approximately the normal temperature of human skin.

4. The expendable thermal target of claim 3, wherein the body portion of the cloth housing configured to generate heat at approximately the normal temperature of clothed human skin.

5. An expendable thermal target for weapon fire, the thermal target being attached to a harder surface for support at the end of a firing range, the thermal target comprising:

(a) a cloth housing, the cloth housing being substantially flat and the approximate shape and the approximate size of a human silhouette, the cloth housing having a head portion, a neck portion and a body portion; and (b) a plurality of independently contained thermal emitting cells disposed within the cloth housing, the thermal emitting cells are manufactured from iron powder, carbon, salt, and vermiculite, the thermal emitting cells are stored in a vacuum container such that upon exposure to air the thermal emitting cells would give off thermal energy, the iron powder, carbon, salt, and vermiculite is exposed to air by opening the vacuum container, the thermal emitting cells located in the head portion and the neck portion configured to generate heat at approximately the normal temperature of human skin, the thermal emitting cells located in the body portion of the cloth housing configured to generate heat at approximately the normal temperature of clothed human skin.

* * * * *